US007251434B2

(12) United States Patent
Ikeda et al.

(10) Patent No.: US 7,251,434 B2
(45) Date of Patent: Jul. 31, 2007

(54) COLOR IMAGE FORMING APPARATUS

(75) Inventors: Miho Ikeda, Kanagawa (JP); Yasuhiro Oda, Kanagawa (JP); Akihisa Maruyama, Kanagawa (JP); Koichiro Yuasa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 181 days.

(21) Appl. No.: 11/225,045

(22) Filed: Sep. 14, 2005

(65) Prior Publication Data

US 2006/0204272 A1 Sep. 14, 2006

(30) Foreign Application Priority Data

Mar. 9, 2005 (JP) ..... P2005-065233

(51) Int. Cl.
*G03G 15/16* (2006.01)
*G03G 21/00* (2006.01)

(52) U.S. Cl. ..... 399/101; 399/349; 399/359

(58) Field of Classification Search ..... 399/101, 399/343, 344, 350, 352, 353, 354, 357, 358, 399/360, 359, 349
See application file for complete search history.

(56) References Cited

U.S. PATENT DOCUMENTS 7,039,353 B2 * 5/2006 Yamada et al. ..... 399/349
2005/0047816 A1 * 3/2005 Uchida et al. ..... 399/101

FOREIGN PATENT DOCUMENTS

JP 09-050163 2/1997
JP 09-244502 9/1997
JP 09-269708 10/1997
JP 10-288933 10/1998
JP 3204076 B 6/2001
JP 3206422 B 7/2001
JP A-2002-287590 10/2002
JP A-2002-311669 10/2002
JP A-2003-150013 5/2003

OTHER PUBLICATIONS

U.S. Appl. No. 11/225,216, filed Sep. 14, 2005.

* cited by examiner

*Primary Examiner*—Hoang Ngo
(74) *Attorney, Agent, or Firm*—Morgan, Lewis & Bockius LLP

(57) ABSTRACT

A color image forming apparatus includes image forming units, an intermediate transfer body, and cleaning units. The image forming units form toner images of different colors. Each image forming units includes a developing unit supplying toner of each color. The toner images of the respective colors formed by the image forming units are primarily transferred onto the intermediate transfer body in a superposed manner. A toner image having been transferred onto the intermediate transfer body is secondarily transferred onto a recording medium. The cleaning units remove a residual toner on the intermediate transfer body. The cleaning units include first and second cleaning units. The first cleaning unit removes from the intermediate transfer body the largest amount of foreign matters, among all the cleaning units. A residual toner removed by at least the second cleaning unit is returned to one of developing units that supplies a black toner.

17 Claims, 8 Drawing Sheets

COLOR IMAGE FORMING APPARATUS

BACKGROUND OF THE INVENTION

1. Field of the Invention

The invention relates to a color image forming apparatus such as a color copying machine, a color printer, and a color facsimile using an electrophotographic system, in particular, to improvement of a color image forming apparatus, which reclaims toner recovered by a cleaning unit, in forming an image.

2. Description of the Related Art

Conventionally, as this kind of a color image forming apparatus such as a color copying machine and a color printer, and a color facsimile using an electrophotographic system, a tandem-type color image forming apparatus has been proposed and come into the market already. In the tandem type color image forming apparatus, four image forming units respectively corresponding to yellow (Y), magenta (M), cyan (C), and black (K) are arranged in series, yellow (Y), magenta (M), cyan (C), black (K) toner images formed by the image forming units are primarily transferred onto an intermediate transfer belt in a superposed manner, then a full-color toner image generated by overlaying these single-color toner images on the intermediate transfer belt is secondarily transferred onto a recording medium all at once, and thereafter the full-color toner image is fixed on the recording medium to form a full-color image.

In the color image forming apparatus, a method including recovering toner remaining on the surface of the intermediate belt and a photoconductor drum by a cleaning unit, and returning the toner recovered by the cleaning unit to a black developing unit to reclaim the recovered toner has been proposed.

According to the above method, foreign matters such as paper debris are attached to the surface of the intermediate transfer belt when the intermediate transfer belt is in contact with a sheet in the second transfer position. The foreign matters attached to the intermediate transfer belt are recovered by the cleaning unit of the intermediated transfer belt, together with the residual toner after the transfer. The toner recovered by the cleaning unit for the intermediate transfer belt is supplied to a developing unit, and then is reclaimed. If the toner is reclaimed, a trimmer of the developing unit is jammed by the foreign matters such as paper debris mixed in the toner. Otherwise, the foreign matters are attached to a background part of a developed image, thereby causing image defects such as color dots.

A method to solve this problem has already been disclosed that, before recovering residual toner after the transfer by the cleaning unit for the intermediate transfer belt, only the foreign matters such as paper debris attached to the surface of the intermediate transfer belt are removed, or the foreign matters such as paper debris are removed from toner recovered by the cleaning unit.

JP2002-311669A discloses the following device. A color image forming device for removing adhering paper has been disclosed which forms a color image on a sheet by transferring toner images formed on respective image carriers of a plurality of imaging means to form a composite toner image on an intermediate transfer body, and then transferring the composite toner image. The device for removing adhering paper is provided in the color image forming device having a toner recycling device, which reuses residual toner after the transfer by putting the residual toner after the transfer back to a developing unit used by the black imaging means among the imaging means. The device for removing adhering paper is provided on upper stream of an image transfer position in a sheet conveyance path.

A color image forming apparatus that includes a plurality of image forming units having at least an image carrier and a developing unit, a transfer unit, which transfers a toner image formed on the image carrier onto a transfer material, and a cleaning unit, which scrapes and recovers residual toner adhering to the image carrier after the image carrier passes through the transfer unit have been disclosed. In the color image forming apparatus, the cleaning unit has a plurality of cleaning members, which scrape and recover residual toner adhering to the image carrier, and toner conveyance paths corresponding to the toner recovered by the respective cleaning members. At least one of the plurality of toner conveyance paths forms a recycled-toner supplying path to a developing unit, and the other toner conveyance paths are connected to a disposal system.

Further, an image forming apparatus that includes a plurality of image carriers, charging and exposing means which forms an electrostatic latent image on the respective image carriers, developing means which visualizes images by adhering toner on the electrostatic latent image formed by the charging and exposing means, transfer means which transfers the toner adhered on the electrostatic latent image onto an intermediate transfer body, and cleaning means which removes the toner adhered on the image carrier after the image carrier passing the transfer means have been disclosed. The cleaning means is provided with a plurality of cleaning members to act on substances adhering onto the image carriers and a plurality of feeding routes for the toner recovered by the cleaning members. One or more of the feeding routes are supply routes of recycled toner to a developing means. The route is selected for each cleaning member.

In the aforementioned method for reclaiming remaining-toner after transfer, the reclaimed toner which is collected by a cleaning means is subject to stress by the cleaning means and the developing unit, which deteriorates the powder characteristics and the charging characteristics. Thus, if a large amount of the reclaimed toner is supplied to the developing unit, photographic fog or cloud is generated. This is a problem.

Furthermore, in the conventional color image forming apparatus, another method, in which after the yellow (Y), magenta (M), cyan (C), and black (K) toner images are transferred, color-mixed toner remaining on the intermediate transfer belt or the photoconductor drums is collected by the cleaning means to be brought back to the black developing unit, has been proposed. However, if a large amount of color-mixed toner is supplied to the black developing unit, the black color changes. This is also a problem.

To solve these problems, methods have been proposed.

An electrophotographic copy machine that includes a photoconductor drum, a developing unit which develops a latent image on the photoconductor drum, toner density detecting means which is provided in the developing unit to detect the density of toner in the developing unit, cleaning means which recovers the residual toner on the photoconductor drum, a toner recovery container which receives discharge toner among the recovered toner, toner recovery means which collects the toner recovered by the cleaning means and unidirectionally discharges it, and switching means which is provided near an end of the toner recovery means to switch the carrying direction of the recovered toner have been proposed. When the toner density detecting means detects the density of the toner in the developing unit is a predetermined value, the switching means is switched so that the recovered toner is collected as the discharged toner. Then, the toner density detecting means performs the toner supplying operation to maintain a proper density of toner. When the supplied toner undergoes an agitating operation, regardless of output of the density of toner inside the developing unit obtained by the toner density detecting means, the toner recovered by the cleaning means is collected for recycling.

a method has been proposed that, when the density of residual toner on photoconductor drums after transfer or the density of toner inside a developing unit exceeds a predetermined value, a path for the toner is changed from a reclaiming path to a discharging path after a power source is turned on or after leaving the device as it is for a predetermined time.

Furthermore, an electrophotographic copy machine that includes a photoconductor drum, a developing unit, cleaning means, toner recovering means, a toner recovery container, first toner conveying means, second toner carrying means, and switching means have been proposed. The developing unit develops a latent image on the photoconductor drum. The cleaning means recovers residual toner on the photoconductor drum. The toner recovering means recovers toner in a predetermined conveying direction from the cleaning means. The toner recovery container accommodates toner for discharging. The first toner conveying means is provided on upper stream of the toner recovering means in the conveying direction so as to convey toner to the developing unit. The second toner conveying means is disposed on downstream of the toner recovering means in the conveying direction so as to convey toner to the toner recovery container. The switching means is disposed inside the toner recovering means so as to switch in accordance with predetermined number of copies between (a) conveying toner from the first toner conveying means and the second toner conveying means and (b) conveying toner from the second toner conveying means alone.

An electrophotographic device that forms an image on a photoconductor using a plurality of different kinds of toner by charging, recording, and developing, and transfers the formed image so as to perform recording on a sheet have been proposed. In the meantime, a cleaning unit removes and recovers residual toner on the photoconductor after the transfer. The electrophotographic device is provided with detecting means, which detects a mixing ratio of the recovered toner.

SUMMARY OF THE INVENTION

However, the related art has the following drawbacks. The device for removing adhering paper is provided in a color image forming apparatus having the toner recycling device, which reuses residual toner after the transfer by putting the residual toner after the transfer back to a developing unit used by a black imaging means among the plurality of imaging means. The device for removing adhering paper is provided on the upper stream of an image transfer position in a sheet conveyance path.

The device for removing adhering paper is disposed on the upper stream of a cleaning unit so as to be brought in contact with or not in contact with means for removing adhering paper such as a brush. The device for removing adhering paper is designed to recover paper debris alone in an electrostatic manner by applying bias voltage to the means for removing adhering paper such as a brush.

However, since the device for removing adhering paper is set not to recover foreign matters such as paper debris and toner having the same polarity as the foreign matters such as paper debris simultaneously. Therefore, the foreign matters are not effectively removed. This is a problem.

The apparatus disclosed above removes foreign matters such as paper debris from the recovered toner with using a filter or a classifying unit. However, when the filter is used, there arises a problem in durability such as clogging. If the classifying unit is used, the apparatus should become enlarged. This is also a problem.

The technique disclosed above is required to use a member such as a shutter to switch a conveyance path. Therefore, toner maybe adhered to the member such as the shutter to cause defects in the opening and closing operation. Such defects deteriorate reliability. Moreover, sliding portions between the members may aggregate toner to form toner grid, resulting in image defect such as white spot.

the present invention has been made in view of the above circumstances and provides a color image forming apparatus, which may remove foreign matters such as paper debris effectively.

According to one embodiment, a color image forming apparatus includes a plurality of image forming units, an intermediate transfer body and a plurality of cleaning units. The image forming units form toner images of different colors from each other. The colors include black. Each of the image forming units includes a developing unit that supplies toner of each color. The toner images of the respective colors formed on the intermediate transfer body by the image forming units are primarily transferred in a superposed manner. A toner image having been transferred onto the intermediate transfer body is secondarily transferred onto a recording medium. The cleaning units remove a residual toner on the intermediate transfer body. The cleaning units include a first cleaning unit and a second cleaning unit. The first cleaning unit removes from the intermediate transfer body the largest amount of foreign matters, among all the cleaning units. A residual toner removed by at least the second cleaning unit is returned to one of the developing units that supplies a black toner.

BRIEF DESCRIPTION OF THE DRAWINGS

Embodiment of the invention will be described in detail based on the following figures, wherein.

DETAILED DESCRIPTION OF THE DRAWINGS

Hereinafter, embodiments of the present invention will be described with reference to the accompanying drawings.

FIRST EMBODIMENT

Figure 2:
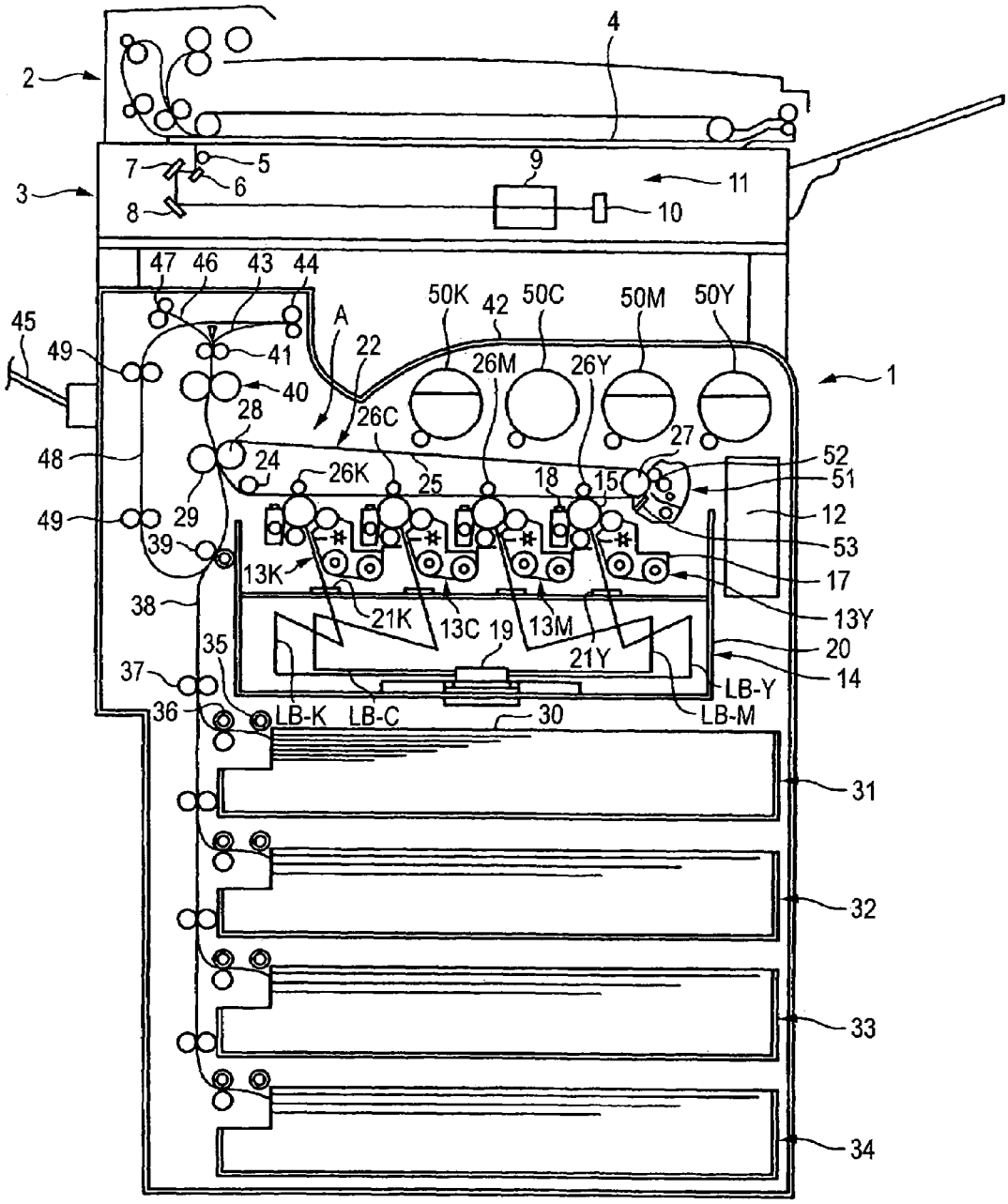
FIG. 2 is a construction view showing the color image forming apparatus according to the first embodiment of the invention.

FIG. 2 is a construction view showing a color complex machine serving as an image forming apparatus according to a first embodiment of the invention. The color complex machine has functions of a copying machine, a printer, and a facsimile.

As shown in FIG. 2, the color complex machine 1 is provided with a scanner 2 serving as an image reading device in an upper part thereof, and is connected to a personal computer (not shown) and so on through networks (not shown).

The color complex machine copies an image of a document read by a scanner, prints out images based on image data coming from a personal computer, and sends and receives image data through telephone lines.

In FIG. 2, reference numeral 1 denotes a main body of the color complex machine. An upper part of the color complex machine main body 1 is provided with an automatic document feeder (ADF) 2 and an image input terminal (IIT) 3. The automatic document feeder automatically feeds documents (not shown) sheet by sheet. The image input device 3 reads an image of the document fed by the automatic document feeder 2. The image input terminal 3 illuminates a document placed on a platen glass 4 by a light source 5. An optical image reflected from the document is exposed to an image reading element 10 composed of a CCD via a reduced optical system 11 including a full rate mirror 6, half rate mirrors 7 and 8, and an imaging lens 9. Thus, the image reading element 10 reads a color optical image reflected from the document in a predetermined dot density (for example, 16 dots/mm).

The optical image, which is reflected from the document and read by the image input terminal 3, is sent to an image processing system (IPS) 12 as reflectance data of red (R), green (G) and blue (B) (each 8 bits). The image processing system 12 performs a predetermined image processing described later for image data of the document. If needed, the image processing includes shading correction, position deviation correction, lightness/color space conversion, gamma correction, stripping, color/shift editing, etc. Further, the image processing system 12 performs the predetermined image processing for image data input from a personal computer (not shown).

The image data for which the predetermined image processing has been performed in the image processing system 12 is converted into gradation data composed of four color components of yellow (Y), magenta (M), cyan (C), and black (K) (each 8 bits) by the image processing system 12. As described below, the gradation data is sent to an ROS (Raster Output Scanner) 14, which is in common to respective image forming units 13Y, 13M, 13C, and 13K corresponding to yellow (Y), magenta (M), cyan (C), and black (K). The ROS 14 serving as an image exposing device exposes photoconductor drums 15 with laser beam LB in accordance with gradation data of a predetermined color. Further, a black and white image may be formed as well as a color image.

As shown in FIG. 2, image forming means A is arranged in the color complex machine 1. The image forming units 13Y, 13M, 13C, and 13K corresponding to yellow (Y), magenta (M), cyan (C), and black (K) are horizontally juxtaposed at predetermined intervals in the image forming means A.

The image forming units 13Y, 13M, 13C, and 13K are constituted in the same manner. Mainly, each image forming unit includes a photoconductor drum 15, a charging roller 16, the ROS 14, a developing unit 17, and a cleaning unit 18. The photoconductor drum 15 serving as an image carrier is driven so as to rotate at a predetermined velocity. The charging roller 16 for primary charging, uniformly charges the surface of the photoconductor drum 15. The ROS 14 serving as an image exposing device forms an electrostatic latent image by exposing an image corresponding to a predetermined color onto the surface of the photoconductor drum 15. The developing unit 17 develops the electrostatic latent image formed on the photoconductor drum 15 with toner of the predetermined color. The cleaning unit 18 cleans the surface of the photoconductor drum 15. In the embodiment, the developing unit 17 accommodates two-component developing agent consisting of carrier and toner. The photoconductor drums 15 and an image forming member disposed around the photoconductor drums 15 are integrally unitized. The units in the color complex machine 1 can be individually replaced.

As shown in FIG. 2, the ROS 14 is shared by the image forming units 13Y, 13M, 13C, and 13K. The ROS 14 modulates four semiconductor lasers (not shown) in accordance with gradation data of the respective colors so that laser beams LB-Y, LB-M, LB-C, and LB-K are output from the semiconductor lasers in accordance with the gradation data. The ROS 14 may be individually provided to each of a plurality of image forming units. The laser beams LB-Y, LB-M, LB-C and LB-K output from the semiconductor lasers are irradiated onto a polygon mirror 19 via an f-θ lens (not shown). Thus, the laser beams LB-Y, LB-M, LB-C and LB-K are deflected and scanned by a polygon mirror 19. The laser beams LB-Y, LB-M, LB-C and LB-K deflected and scanned by the polygon mirror 19 are exposed and scanned to an exposure point on the photoconductor drum 15 from obliquely below, via an imaging lens and a plurality of mirrors (not shown).

As shown in FIG. 2, since the ROS 14 scans and exposes an image onto the photoconductor drum 15 from below, toner from the developing units 17 corresponding to the image forming units 13Y, 13M, 13C, and 13K located in an upper position may drop onto the ROS 14, thereby staining the ROS 14. For this reason, the ROS 14 is housed by a rectangular parallelepiped frame 20. The upper part of the frame 20 is formed with transparent windows 21Y, 21M, 21C and 21K, which are made of glass and serve as a shield member, so as to expose the photoconductor drums 15 corresponding to the image forming units 13Y, 13M, 13C, and 13K to the laser beams LB-Y, LB-M, LB-C and LB-K.

The image data processing device 12 sequentially outputs image data of each color to the ROS 14 shared by the image forming units 13Y, 13M, 13C, and 13K respectively corresponding to yellow (Y), magenta (M), cyan (C), and black (K). The laser beams LB-Y, LB-M, LB-C and LB-K output from the ROS 14 corresponding to image data are radiated onto the surface of the photoconductor drums 15, thereby forming electrostatic latent images. The developing units 17Y, 17M, 17C and 17K develops the electrostatic latent images formed on the photoconductor drums 15 as toner images respectively corresponding to yellow (Y), magenta (M), cyan (C), and black (K).

The toner images sequentially formed on the photoconductor drum 15 of the image forming units 13Y, 13M, 13C, and 13K respectively corresponding to yellow (Y), magenta (M), cyan (C), and black (K) are transferred in a superposed manner onto an intermediate transfer belt 25 of a transfer unit 22, which is disposed over the image forming units 13Y, 13M, 13C, and 13K, by four of primary transfer rollers 26Y, 26M, 26C and 26K. The primary transfer rollers 26Y, 26M, 26C and 26K are arranged on the rear side of the intermediate transfer belt 25 so as to correspond to the photoconductor drums 15 of the image forming units 13Y, 13M, 13C, and 13K. In the embodiment, volume resistances of the primary transfer rollers 26Y, 26M, 26C and 26K are adjusted in the range of $10^5$ to $10^8$ Ωcm. A transfer bias power source (not shown) is connected to the primary transfer rollers 26Y, 26M, 26C and 26K. Transfer bias having an opposite polarity (positive polarity in the embodiment) to a predetermined toner polarity is applied to the primary transfer rollers 26Y, 26M, 26C and 26K at a predetermined timing.

As shown in FIG. 2, the intermediate transfer belt 25 is stretched with a constant tension over a drive roller 27, a tension roller 24 and a back-up roller 28. The intermediate transfer belt 25 is driven and circulated in the direction indicated by an arrow with a predetermined velocity, by the drive roller 27. The drive roller 27 is rotatably driven by a driving-motor (not shown), which is superior in a constant velocity. The intermediate transfer belt 25, for example, is made of materials (rubber or resin), which do not generate charge-up.

As shown in FIG. 2, the toner images transferred in a superposed manner onto the intermediate transfer belt 25 respectively corresponding to yellow (Y), magenta (M), cyan (C), and black (K) are secondarily transferred onto paper 30 serving as a sheet material, by a secondary transfer roller 29 brought into contact with the back-up roller 28. The paper 30 onto which toner images of each color have been transferred is conveyed to a fixing unit 40 located in the upper part. The secondary transfer roller 29 is brought into contact with the back-up roller 28, and secondarily transfers toner image of each color onto a paper 30 conveyed upward from below.

The paper 30 fed from one of a plurality of sheet feeding trays 31, 32, 33, and 34 arranged in a plurality of steps in an up-and-down direction in the lower part of the color complex machine main body 1 is conveyed along a conveying path 38 having a conveying roller 37. Each feeding tray accommodates its own predetermined size of paper sheet, and the predetermined size of paper sheets are fed one by one by a feed roller 35 and a retard roller 36. A paper 30 fed from one of the plurality of sheet feeding trays 31, 32, 33, and 34 is stopped once by a resist roller 39, and again fed to a second transfer position of the intermediate transfer belt 25 by the resist roller 39, in synchronization with images on the intermediate transfer belt 25.

As shown in FIG. 2, a fixing process is performed on the paper 30 onto which toner images of each color have been transferred, by the fixing unit 40 by means of heat and pressure. Then, a surface on which images are formed is faced down by a conveying roller 41, and then the paper 30 is discharged onto a face-down tray 42 formed in the upper part of the color complex machine main body 1, via a first sheet conveying path 43 for discharging the paper 30 onto the face-down tray 42 serving as a first discharging tray, by a discharge roller 44 formed in the outlet of the first sheet conveying path 43.

When the paper 30 is discharged while the surface on which images are formed is faced up, the paper 30 is discharged onto a face-up tray 45 formed at a side (left side in the drawing) of the color complex machine main body 1, via a second sheet conveying path 46 for discharging the paper 30 onto the face-up tray 45 serving as a second discharging tray with the image formed surface faced up, by a discharge roller 47 formed in the outlet of the second sheet conveying path 46, as shown in FIG. 2.

When a double-sided copy of full color images is performed in the color complex machine 1, the paper 30 with images fixed on a single surface thereof is not discharged onto the face-down tray 42 by the discharge roller 44, but the conveying direction is switched by a switching gate (not shown) and inverted after the discharge roller 44 is once stopped. Then, the paper 30 is conveyed to a sheet conveying path 48 for double side by the discharge roller 44, as shown in FIG. 2. In the sheet conveying path 48 for double side, while the paper 30 is inverted by a conveying roller 49 formed along the conveying path 48, the paper 30 is again conveyed to the resist roller 39. Next, after an image is transferred and fixed on the rear surface of the paper 30, the paper 30 passes through any one of the first sheet conveying path 43 and the second sheet conveying path 46, and is discharged onto any one of the face down tray 42 and the face up tray 45.

Reference numerals 50Y, 50M, 50C, and 50K in FIG. 2 denote toner cartridges, which supply toner of a predetermined color to the respective developing units 17 corresponding to yellow (Y), magenta (M), cyan (C), and black (K).

Figure 3:
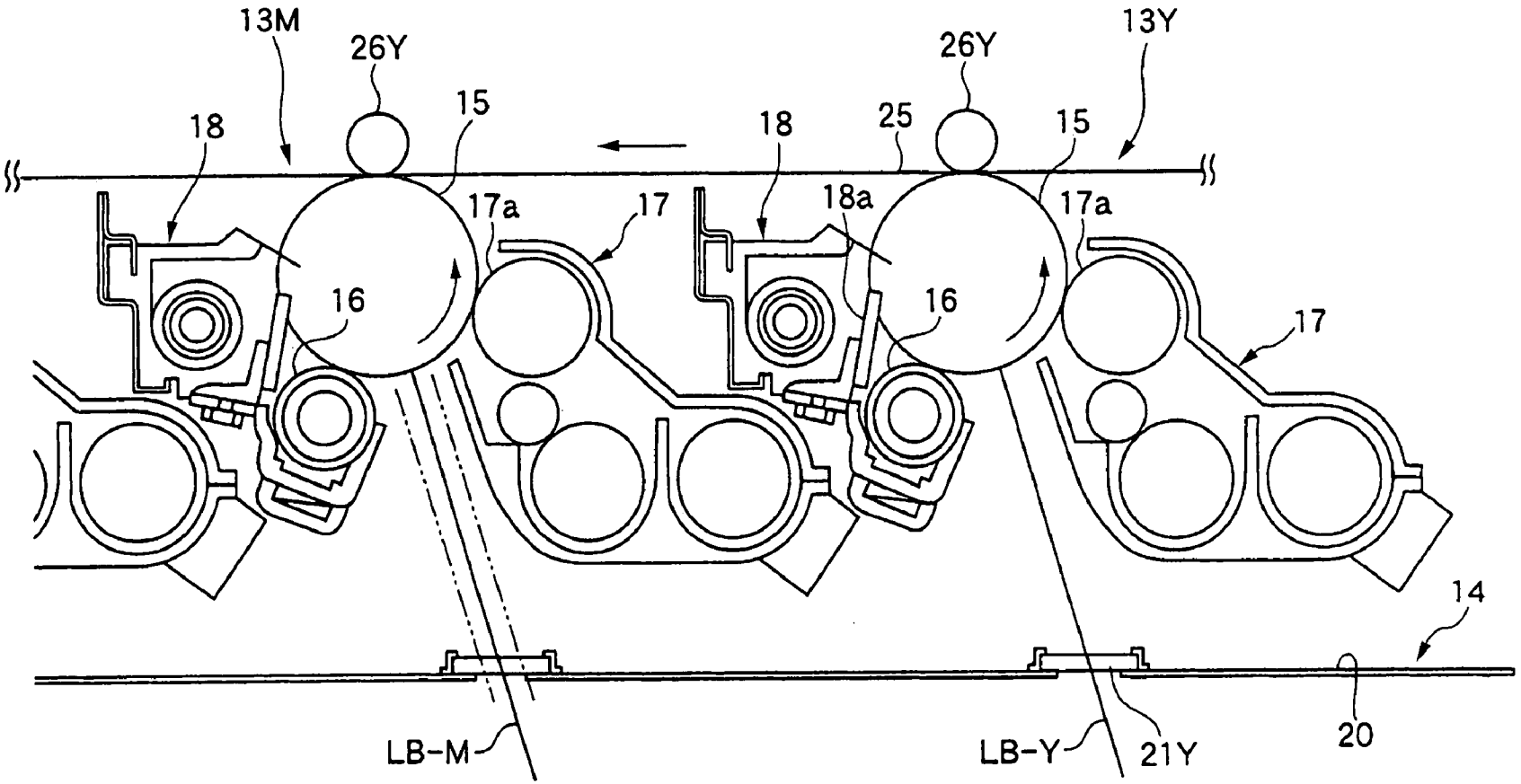
FIG. 3 is a construction view showing image forming units of the color image forming apparatus according to the first embodiment of the invention.

FIG. 3 shows the image forming units of the color image complex machine 1.

The image forming units 13Y, 13M, 13C, and 13K respectively corresponding to yellow, magenta, cyan, and black are constituted in the same manner as shown in FIG. 3. In the image forming units 13Y, 13M, 13C, and 13K, as described above, toner images respectively corresponding to yellow, magenta, cyan, and black are sequentially formed at a predetermined timing. The image forming units 13Y, 13M, 13C, and 13K respectively have the photoconductor drums 15. The surface of each photoconductor drum 15 is uniformly charged by the charging roller 16 for primary charging, as described above. Thereafter, the surface of the photoconductor drum 15 is exposed and scanned by the laser beam LB for image forming output from the ROS 14 based on image data, thereby forming an electrostatic latent image corresponding to each color. The laser beam LB exposing and scans the photoconductor drum 15 exposes from the right and obliquely lower portion of the surface of the photoconductor drum 15. The electrostatic latent images formed on the photoconductor drums 15 are developed into visual toner images by developing rollers 17*a* of the developing units 17 respectively corresponding to the image forming units 13Y, 13M, 13C, and 13K, with using each toner of yellow, magenta, cyan, and black. The visual toner images are sequentially transferred in a superposed manner onto the intermediate transfer belt 25 since the primary transfer roller 26 is charged.

After the processing for transferring toner images is finished, the toner remaining on the surface of the photoconductor drum 15 is removed by a cleaning unit 18, and the surface of the photoconductor drum 15 is prepared for the next image forming process. The cleaning unit 18 includes a cleaning blade 18*a*, and removes the toner remaining on the photoconductor drum 15 with the cleaning blade 18*a*.

Although not shown, the toner recovered by the cleaning unit 18 may be conveyed to the developing unit for each color and be reused.

A color image forming apparatus according to the first embodiment includes a plurality of image forming units, an intermediate transfer body, and a plurality of cleaning units. The image forming units form toner images of different colors from each other. The colors include black. Each of the image forming units includes a developing unit that supplies toner of each color. The toner images of the respective colors formed by the image forming units are primarily transferred onto the intermediate transfer body in a superposed manner. A toner image having been transferred onto the intermediate transfer body is secondarily transferred onto a recording medium. The cleaning units remove a residual toner on the intermediate transfer body. The cleaning units include a first cleaning unit and a second cleaning unit. The first cleaning unit removes from the intermediate transfer body the largest amount of foreign matters, among all the cleaning units. A residual toner removed by at least the second cleaning unit is returned to one of the developing units that supplies a black toner.

One of the cleaning units is disposed on the most upstream in a moving direction of the intermediate transfer body among all the cleaning units. What is removed by the one of the cleaning units from the intermediate transfer body is discarded.

One of the cleaning units is disposed on the most upstream in a moving direction of the intermediate transfer body among all the cleaning units. The one of the cleaning units is a brush-shaped cleaning unit. The others of the cleaning units are ones selected from the group consisting of a brush-shaped cleaning unit and a blade-shaped cleaning unit.

The color image forming apparatus has a cleaning device 51, which removes toner remaining on the intermediate transfer belt 25 serving as an intermediate transfer body, after transfer as shown in FIG. 2. Of the plurality of cleaning units, the cleaning device 51 has a conductive brush 52 serving as a first cleaning unit and a cleaning blade 53 serving as a second cleaning unit. The conductive brush 52 and the cleaning blade 53 are partitioned by a partitioning wall 57. Foreign matters such as paper debris recovered by the conductive brush 52 and the cleaning blade 53 are prevented from being mixed with the toner. The front end of the partitioning wall 57 is spaced apart from the surface of the intermediate transfer belt 25 with a predetermined distance (for example, several millimeters).

Figure 1:
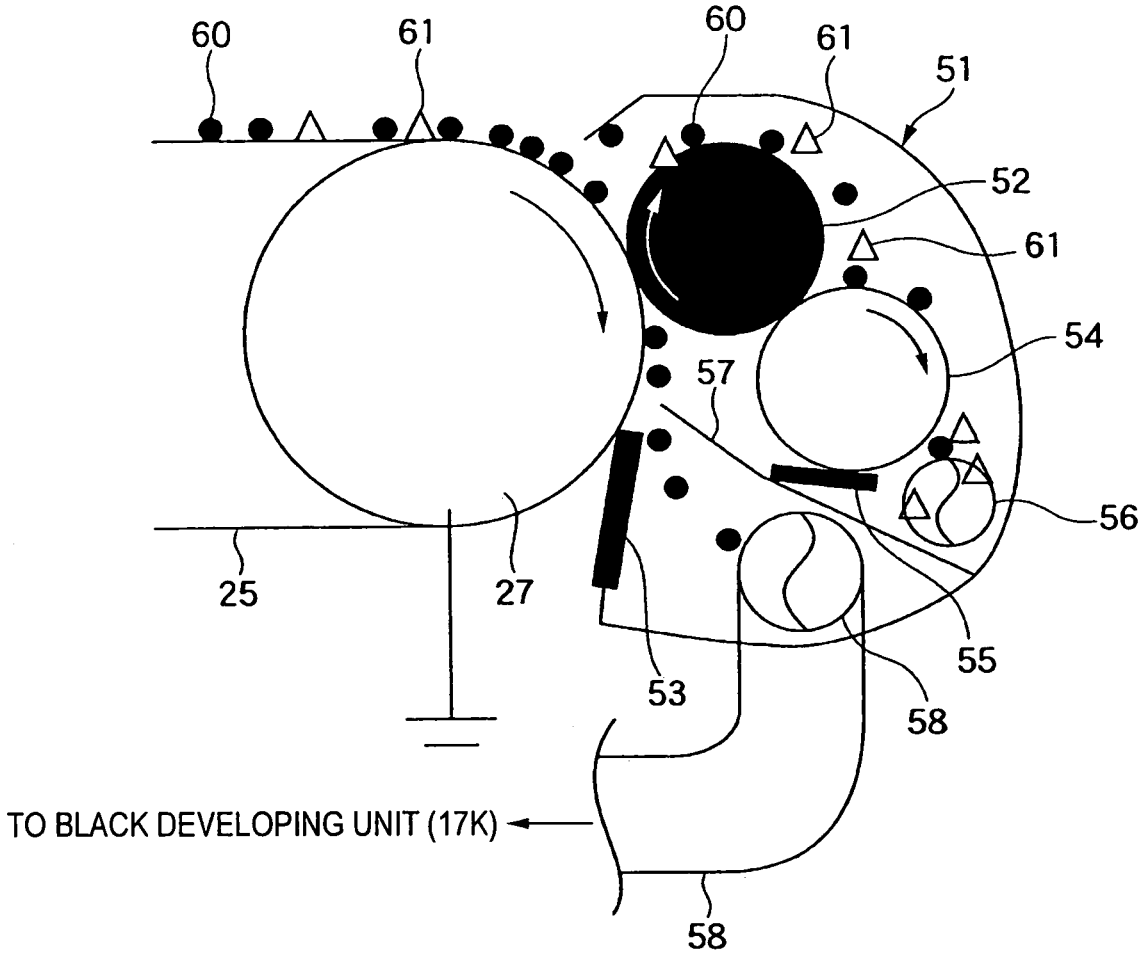
FIG. 1 is a construction view showing substantial parts of a color image forming apparatus according to a first embodiment of the invention.

As shown in FIG. 1, in the cleaning device 51, the conductive brush 52 serving as the first cleaning unit is arranged on the upper stream in the moving direction of the intermediate transfer belt 25 so as to rotate in a direction reverse to or the same direction as the moving direction of the intermediate transfer belt 25 with a predetermined rotation velocity. The conductive brush 52 is configured such that fine and long conductive fibers of 2 denier are densely implanted in a cylindrical base material with a density of 200,000/inch$^2$. The conductive brush 52 is in contact with the surface of the intermediate transfer belt 25 so that the conductive brush 52 bites into the surface of the intermediate transfer belt 25 by 0 to 2.5 mm. The rotation velocity of the conductive brush 52 is set to 0.1 to 3 times the circumferential velocity of the intermediate transfer belt 25. In the meantime, when the conductive brush 52 is rotated in the same direction as that of the intermediate transfer belt 25, the rotation velocity is set to 1.1 to 5 times the circumferential velocity of the intermediate transfer belt 25. The optimum rotation direction can be selected in consideration of easy design, a kind of toner, secondary transfer conditions, physical properties of the intermediate transfer belt 25, the recovery performance depending on kinds of the conductive brush 52, etc.

The conductive brush 52 faces the drive roller 27 with the intermediate transfer belt 25 interposed therebetween, and is maintained to have the same electric potential as that of the drive roller 27. Since residual toner after the transfer is charged negatively or positively, it is hard for the conductive brush 52 to mechanically recover the toner, which is electrically adhered onto the intermediate transfer belt 25. However, paper debris has less quantity of electric charge than toner, thereby having small electric adhesion. Also, the paper debris is larger than the toner. Thus, the paper debris attaches to the intermediate transfer belt 25 more easily caught and recovered by the conductive brush 52 in comparison with the toner.

Toner regularly charged to have a negative polarity is used in the embodiment. Voltage having a negative polarity is applied to the intermediate transfer belt 25 grounded. Therefore, while the residual toner after the transfer, which is negatively charged, is recovered, the paper debris having a positive polarity can be further recovered by means of electrical power, thereby improving the recovery rate of the paper debris (foreign matters).

By the above-mentioned effect, foreign matters such as paper debris can be preferentially recovered by the conductive brush 52.

Furthermore, a detoning roller 54 formed of a metal roller is in contact with the surface of the conductive brush 52. The foreign matters such as paper debris recovered by the conductive brush 52 are transferred onto the surface of the detoning roller 54 by means of an electrostatic force or a physical adhesion force. At this moment, a voltage is applied to the detoning roller 54 to generate negative electrical fields in the conductive brush 52. A scraper 55 scrapes and drops the foreign matters such as paper debris transferred onto the surface of the detoning roller 54. Then, a conveying member 56 such as an auger conveys the foreign matters to a disposal path, thereby recovering the foreign matters in a recovery box (not shown) The scraper 55 made of metal materials is pressingly in contact with the detoning roller 54.

The conductive brush 52 may be arranged to be not in contact with the intermediate transfer belt 25 but to remove the foreign matters such as paper debris with electrostatic force alone. At this moment, the gap between the conductive brush 52 and the intermediate transfer belt 25 is set below 2 mm.

According to this configuration, while the recovery rate of paper debris slightly decreases, an amount of toner, which is recovered by the cleaning units located on the downstream and reused by the black developing unit described later, can increase.

In the meantime, the cleaning blade 53 is formed of, for example, a synthetic resin such as urethane rubber having a predetermined thickness. The cleaning blade 53 is arranged to be pressingly in contact with the surface of the intermediate transfer belt 25 from the direction opposite to the moving direction of the intermediate transfer belt 25 so as to function as a so-called "doctor blade". Since toner recovered by the cleaning blade 53 is reclaimed in forming images, the conveying member 58 such as a long auger conveys the toner to the black developing unit 17, and the conveyed toner is supplied to the black developing unit 17 together with new toner at one time or at different timing. In place of the cleaning blade 53, a scraper made of a metal thin plate, a rotating brush, or a conductive brush may be used as the second cleaning unit.

According to the above-mentioned configuration, the color image forming apparatus according to the first embodiment can effectively remove foreign matters such as paper debris, and has sufficient durability. In addition, a size of the color image forming apparatus is not increased.

As shown in FIG. 2, in the color image forming apparatus according to the first embodiment, the toner images having predetermined colors are formed by the image forming units 13Y, 13M, 13C, and 13K of yellow (Y), magenta (M), cyan (C), and black (K). The toner images formed by the image forming units 13Y, 13M, 13C, and 13K of the respective colors are transferred in a superposed manner onto the intermediate transfer belt 25. Then, the toner images transferred in a superposed manner onto the intermediate transfer belt 25 are secondarily transferred onto the paper 30 at the second transfer position all at once, and are fixed by the fixing unit 40. As a result, a full-color image is formed.

At this moment, after the processing for secondarily transferring the yellow (Y), magenta (M), cyan (C), and black (K) toner images is completed, residual toner 60, which has not been transferred onto the paper 30, remains on the intermediate transfer belt 25, and foreign matters 61 such as paper debris stay adhered onto the intermediate transfer belt 25 due to the contact with the paper 30.

However, as described above, among the residual toner 60 and the foreign matters 61 such as paper debris on the surface of the intermediate transfer belt 25, the residual toner 60 and the foreign matters 61 such as paper debris whose polarity has been reversed to positive polarity are selectively removed by the first cleaning unit located on the upper stream, move to the cleaning blade 53 located on the downstream so that the residual toner 60 adhered onto the intermediate transfer belt 25 is mainly removed and recovered by the cleaning blade 53. Further, the conveying member 58 such as a long auger conveys the residual toner 60 to the black developing unit 17 so that the residual toner 60 is supplied to the black developing unit 17 together with new toner at one time or at different timing, thereby again being reused in developing.

As described above, the color image forming apparatus according to the first embodiment uses a plurality of cleaning units including the conductive brush 52 and the cleaning blade 53 serving as cleaning units. The foreign matters 61 such as paper debris are selectively recovered by the conductive brush 52 located on the upper stream and at the same time the residual toner 60 is selectively recovered by the cleaning blade 53 located on the downstream, thereby improving the efficiency in removing the foreign matters 61 such as paper debris from the toner, which is to be recovered by the cleaning blade 53 on the downstream and to be reused in the black developing unit. In addition, the color image forming apparatus does not have a sliding portion and has sufficient durability. Furthermore, the size of the color image forming apparatus is not increased.

Furthermore, the plurality of cleaning units is integrated, and thus downsized. Also, maintenance workability is excellent.

In the first embodiment, from the viewpoint of efficient use of the residual toner, keeping image quality, and downsized recovering box for discharged toner, it is preferable that the conductive brush 52 on the upstream side recovers about 50% or less of the residual toner and that the cleaning blade 53 on the downstream side recovers about 50% or more of the residual toner.

Figure 4:
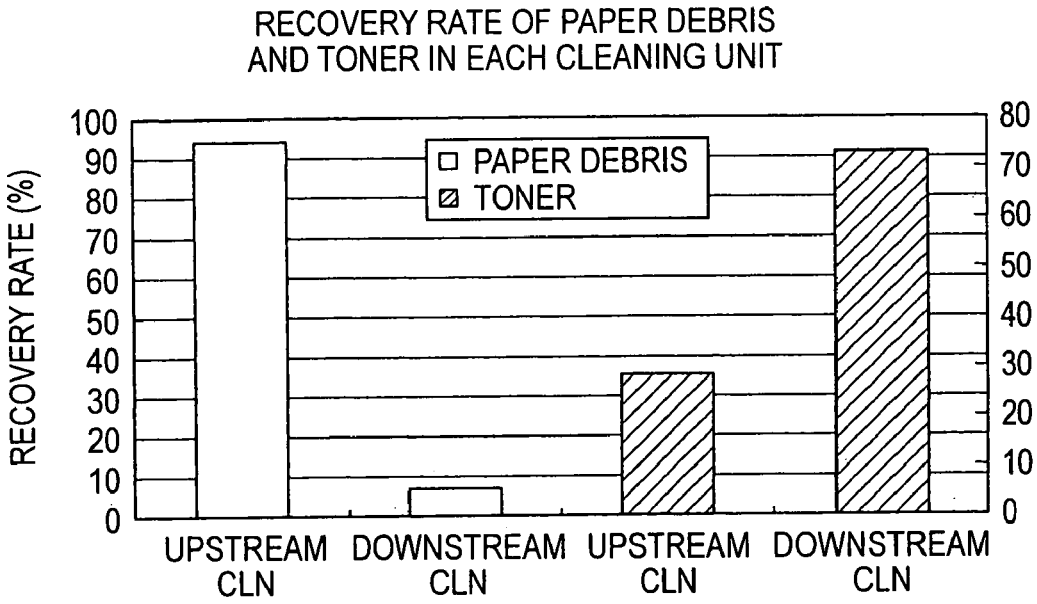
FIG. 4 is a graph showing a result of an experiment of the color image forming apparatus according to the first embodiment of the invention.

The inventors manufactured a color image forming apparatus according to the first embodiment as a prototype. FIG. 4 shows a result of an experiment obtained by measuring the recovery rates of the residual toner and the foreign matters such as paper debris recovered by the conductive brush 52 and the cleaning blade 53.

As can be seen in FIG. 4, about 93% of the paper debris can be selectively removed by the conductive brush 52 on the upstream side and about 71% of the residual toner can be selectively removed by the cleaning blade 53 on the downstream side. Therefore, if the black developing unit 17K reuses the residual toner recovered by the cleaning blade 53 on the downstream side, the trimmer of the developing unit is prevented from being clogged up with the foreign matters such as paper debris mixed in the toner. Further, image defects such as color dots caused by the foreign matters attached to a background part of a developed image can be prevented, thereby forming a satisfactory image.

SECOND EMBODIMENT

Figure 5:
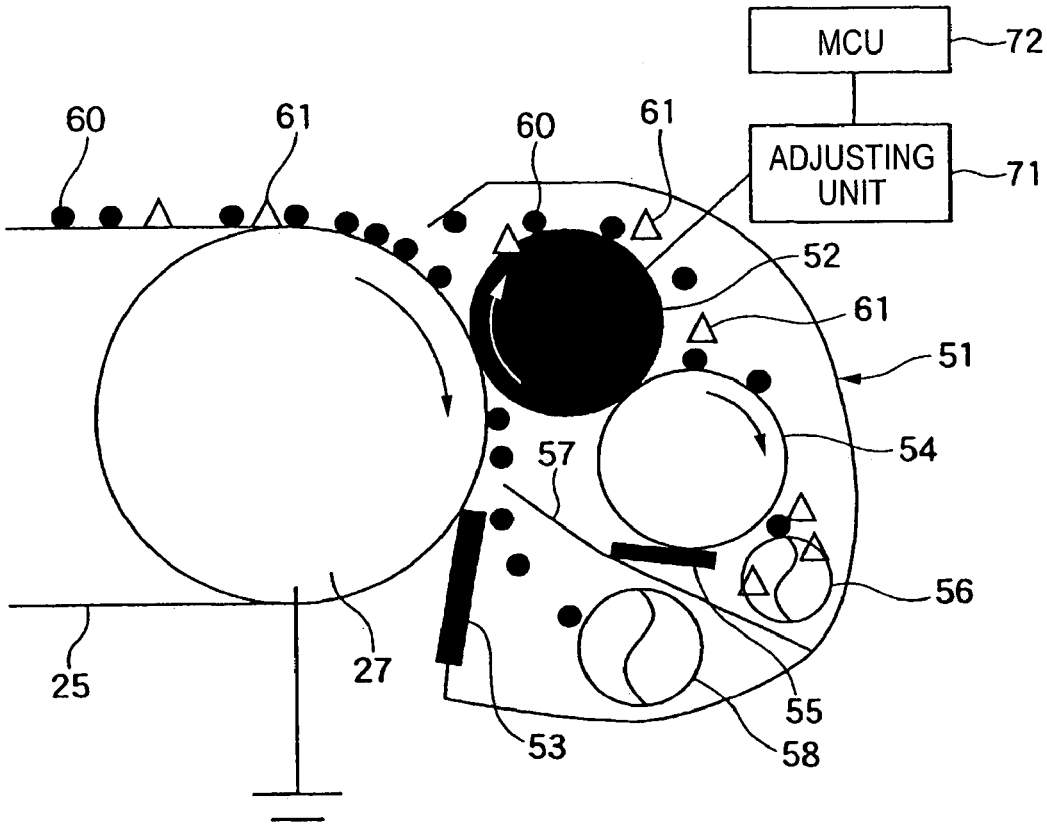
FIG. 5 is a construction view showing substantial parts of a color image forming apparatus according to a second embodiment of the invention.

FIG. 5 shows a second embodiment of the invention. In FIG. 5, constituent elements similar to those of the first embodiment are denoted by the same reference numerals. The color image forming apparatus according to the second embodiment has a plurality of image forming units for forming toner images of different colors. The color image forming apparatus transfers toner images formed by the image forming units onto an intermediate transfer body, and then secondarily transfers the toner images onto a recording medium, thereby forming an image. Further, a plurality of cleaning units for removing toner remaining on the intermediate transfer body after the transfer are arranged. The toner recovered by at least one of the plurality of cleaning units is returned to a black developing unit so as to be reused. A control unit controls an amount of toner, which is recovered by the cleaning unit and returned to the black developing unit so as to be reused.

In the second embodiment, the amount of the toner returned to the one of the developing units is adjusted in accordance with at least one of: image information, a toner density within the one of the developing units, and an environmental condition.

One of the cleaning units is disposed on the most upstream in a moving direction of the intermediate transfer body among all the cleaning units. The amount of the toner returned to the one of the developing units is adjusted by the one of the cleaning units.

A voltage applied to a-brush-shaped cleaning unit is adjusted to adjust the amount of the toner returned to the one of the developing units by at least the second cleaning unit.

An amount of brush-belt interference by which a brush-shaped cleaning unit bites into the intermediate transfer body is adjusted to adjust the amount of the toner returned to the one of the developing units by at least the second cleaning unit.

A rotation speed of a brush-shaped cleaning unit is adjusted to adjust the amount of the toner returned to the one of the developing units by at least the second cleaning unit.

Namely, as shown in FIG. 5, the cleaning device 51 according to the second embodiment includes a adjusting unit 71. The adjusting unit adjusts an amount of residual toner recovered by the conductive brush on the upstream side, thereby adjusting an amount of residual toner recovered by a cleaning unit composed of the cleaning blade 53, which recovers toner to be returned to the black developing unit 17 and reused.

The adjusting unit 71 is configured to adjust the amount of the residual toner recovered by the conductive brush 52, in accordance with at least one of image information (color information of images), toner density within the developing unit 17K, and environmental conditions such as temperature and humidity, by an MCU 72, which controls the entire operations of the color image forming apparatus.

As to the image information, when the rate of toner image of Y color, M color, and C color is higher than that of K color, the toner recovered by the cleaning unit on the downstream side has toner of Y color, M color, and C color having higher rate than K color. Therefore, if a large amount of the toner is reused with using the black developing unit, the brightness of K color image becomes brighter or the K color image looks as if it is colored with the other color components. Accordingly, when the rate of an image of Y color, M color, and C color is higher than that of K color, the adjusting unit 71 decreases the amount of toner recovered by the cleaning unit on the downstream side for reuse. On the other hand, when a ratio of the K color image such as a character image is higher than ratio of the other color images, the adjusting unit 71 increases the amount of recovered toner.

In the meantime, since various mechanical stresses are applied to the toner recovered by the cleaning unit, the recovered toner has less conductivity than new toner. Therefore, under a high-humidity environment, which is likely to degrade the conductivity of the toner in the developing unit, or when the toner density is high, if a large amount of toner recovered by the cleaning unit is supplied to the developing unit, the conductivity of the toner further deteriorates, and toner clouds from the developing unit increase to contaminate the inside of the apparatus.

Therefore, under a high-humidity environment, or when toner density is high, the adjusting unit 71 decreases the amount of toner recovered by the cleaning unit on the downstream, and vice versa, increases the amount of recovered toner.

Figure 6:
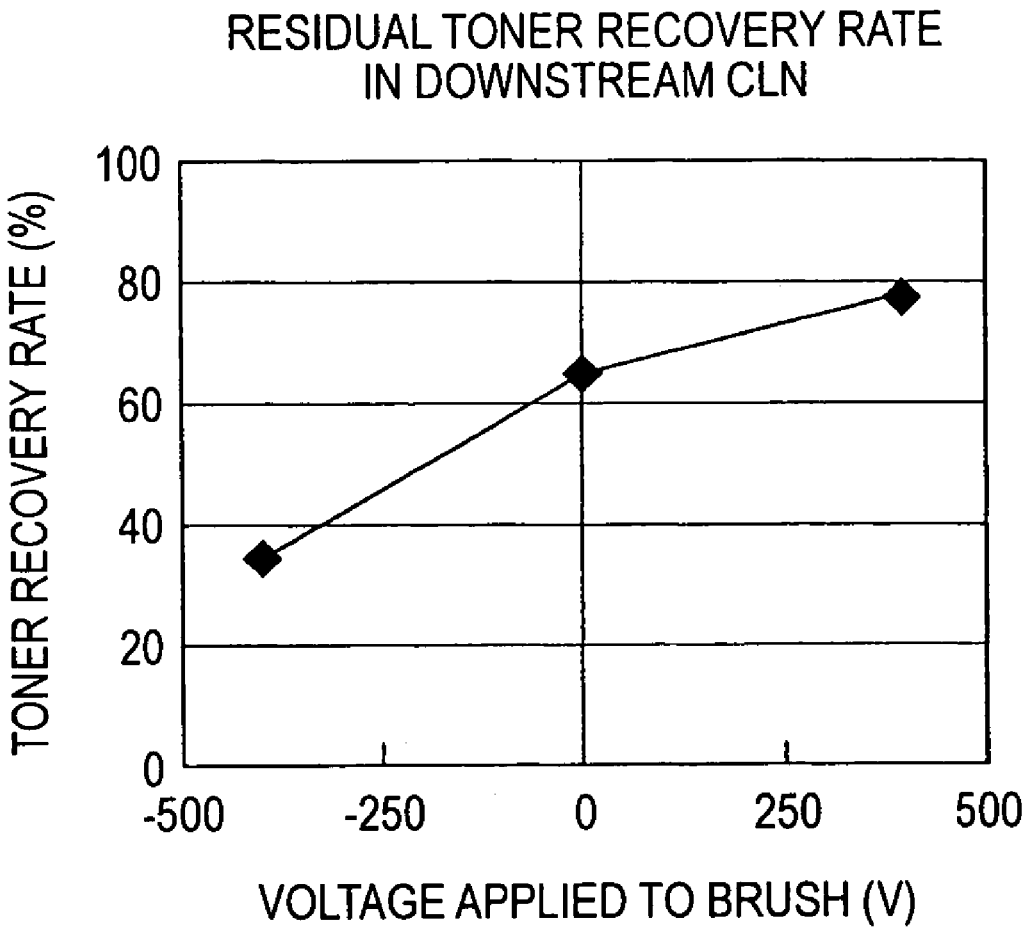
FIG. 6 is a graph showing the result of an experiment of the color image forming apparatus according to the second embodiment of the invention.

For example, the adjusting unit 71 may adjust voltage applied to the conductive brush 52 ass shown in FIG. 6, to adjust the amount of toner recovered by the cleaning unit. The adjusting unit 71 is capable of adjusting the voltage applied to the conductive brush 52 within a range of about −400V to +400V.

When the voltage to be applied to the conductive brush 52 is changed in three steps of −400V, 0V, +400V, as shown in FIG. 6, the recovery rate of the residual toner recovered by the cleaning blade 53 can be changed to about 35%, 65%, and 80%. When a full-color image such as a color picture image, which is likely to generate the residual toner 60 including higher rates of toner of Y color, M color, and C color on the intermediate transfer belt 25, or under a high-humidity environment, the voltage applied to the conductive brush 52 is set to approximately −400V, thereby suppressing the recovery rate of the residual toner recovered by the cleaning blade 53. On the other hand, when the K color image such as a character image or a single-color image is processed, or under a low-humidity environment, the voltage applied to the conductive brush 52 is approximately set to +400V, thereby increasing the recovery rate of the residual toner recovered by the cleaning blade 53.

The adjusting unit 71 for adjusting the voltage applied to the conductive brush 52 has a relatively simple configuration, and is easily realized.

Figure 7:
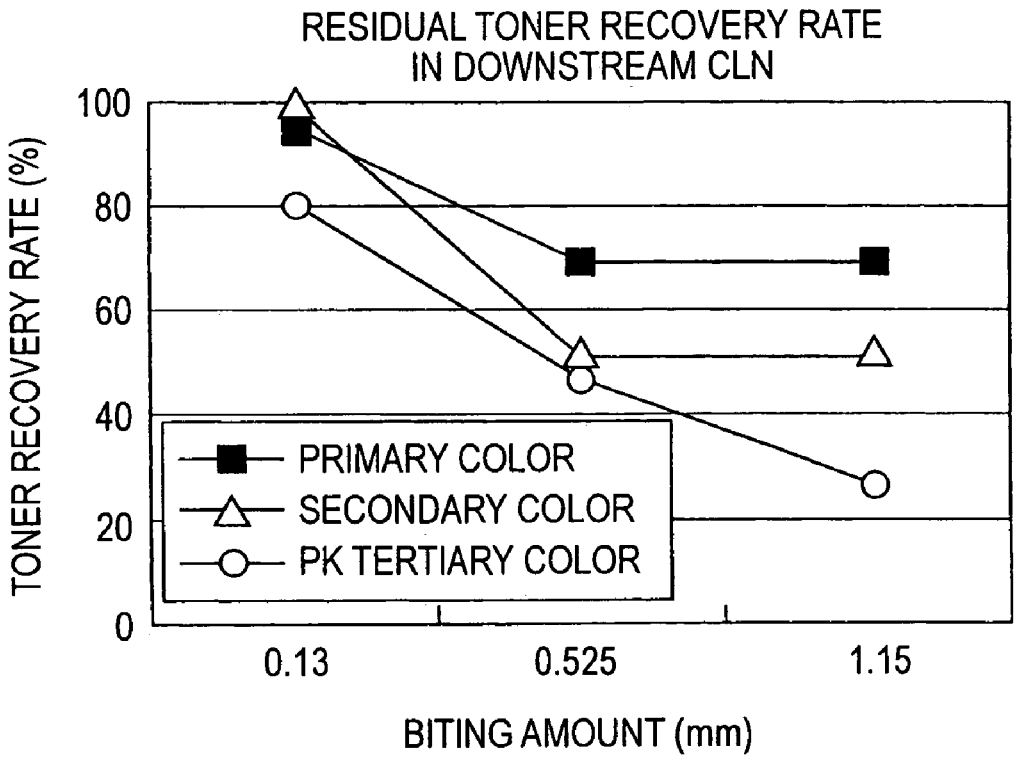
FIG. 7 is a graph showing the result of another experiment of the color image forming apparatus according to the second embodiment of the invention.

Moreover, the adjusting unit 71 may adjust an amount of brush-belt interference by which the conductive brush 52 bites into the intermediate transfer belt 25, to adjust the amount of residual toner recovered by the cleaning unit as shown in FIG. 7. The adjusting unit 71 is capable of adjusting an amount of brush-belt interference by which the conductive brush 52 bites into the intermediate transfer belt 25, to 0.13 mm, 0.525 mm, and 1.15 mm.

In this way, as shown in FIG. 7, the adjusting unit 71 can adjust the recovery rate of the residual toner recovered by the cleaning blade 53 in a range of about 100%, 70% to 50%, and 70% to 30%, by adjusting the amount of brush-belt interference by which the conductive brush 52 bites into the intermediate transfer belt 25.

As shown in FIG. 7, the adjusting unit 71 can adjust the recovery rate of the residual toner recovered by the cleaning blade 53 in a wide range, by adjusting the amount brush-belt interference by which the conductive brush 52 bites into the intermediate transfer belt 25.

Figure 8:
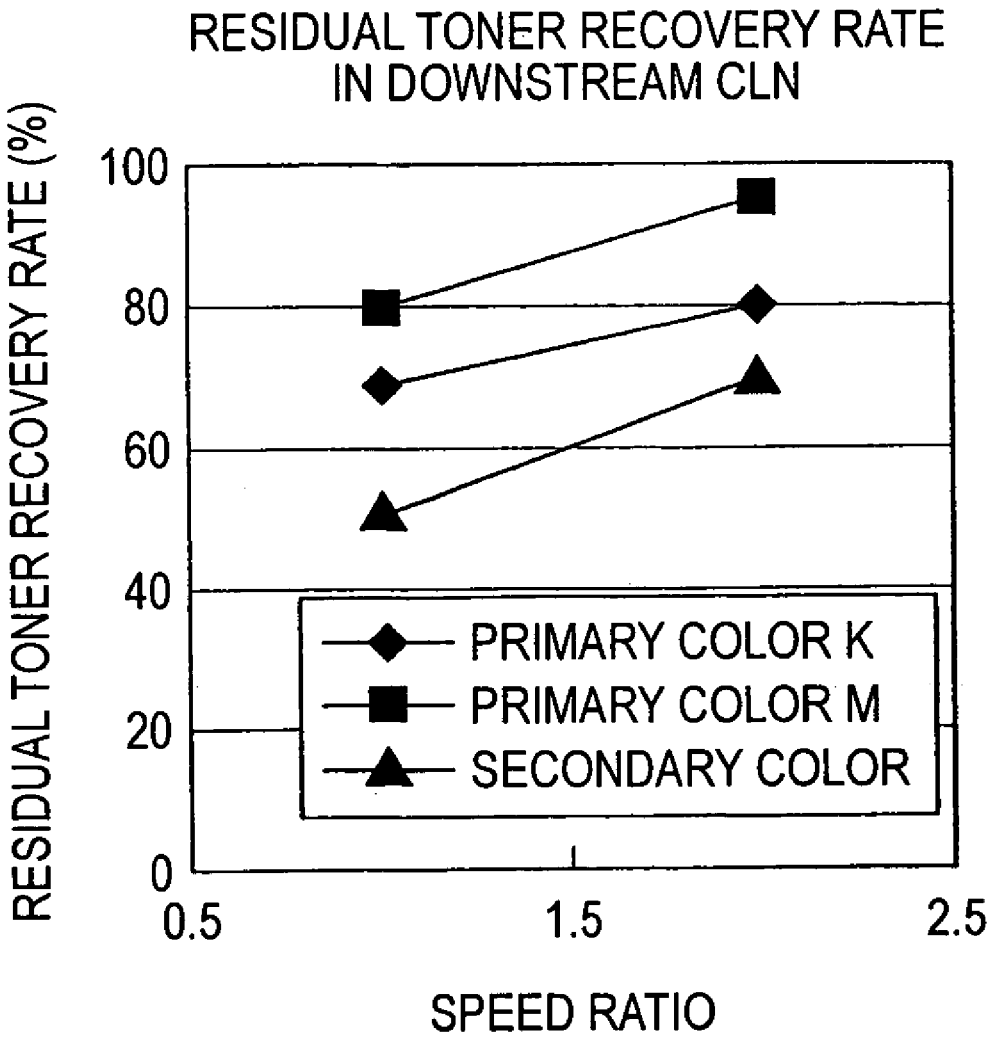
FIG. 8 is a graph showing the result of a further experiment of the color image forming apparatus according to the second embodiment of the invention.

Also, as shown in FIG. 8, the adjusting unit 71 may change a rotation speed of a driving motor for rotating/driving the conductive brush 52 to adjust a speed ration of the conductive brush 52 to the intermediate transfer belt 25, so as to adjust an amount of residual toner recovered by the cleaning unit. For example, the adjusting unit 71 can adjust the speed ratio of the conductive brush 52 to the intermediate transfer belt 25 in a range of 1.0 and 2.0.

The adjusting unit 71 capable of adjusting the speed ratio of the conductive brush 52 to the intermediate transfer belt 25 has a relatively simple configuration, and is easily realized.

According to the second embodiment, it is possible to provide a color image forming apparatus, which reliably operates and prevents aggregation of toner by sliding parts from occurring and image defects such as white spots, without using an opening/closing member such as a shutter.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A color image forming apparatus comprising:

a plurality of image forming units that form toner images of different colors from each other, wherein the colors include black, and each of the image forming units comprises a developing unit that supplies toner of each color;

an intermediate transfer body onto which the toner images of the respective colors formed by the image forming units are primarily transferred in a superposed manner, wherein the toner images having been transferred onto the intermediate transfer body is secondarily transferred onto a recording medium; and a plurality of cleaning units that remove a residual toner on the intermediate transfer body, the cleaning units including a first cleaning unit and a second cleaning unit, wherein:

the first cleaning unit removes from the intermediate transfer body the largest amount of foreign matters, among all the cleaning units, a residual toner removed by at least the second cleaning unit is returned to one of the developing units that supplies a black toner.

2. The apparatus according to claim 1, wherein:

one of the cleaning units is disposed on the most upstream in a moving direction of the intermediate transfer body among all the cleaning units, and what is removed by the one of the cleaning units from the intermediate transfer body is discarded.

3. The apparatus according to claim 1, wherein:

one of the cleaning units is disposed on the most upstream in a moving direction of the intermediate transfer body among all the cleaning units, the one of the cleaning units is a brush-shaped cleaning unit, and the others of the cleaning units are ones selected from the group consisting of a brush-shaped cleaning unit and a blade-shaped cleaning unit.

4. The apparatus according to claim 1, wherein:

one of the cleaning units is disposed on the most upstream in a moving direction of the intermediate transfer body among all the cleaning units, the one of the cleaning units is a brush-shaped cleaning unit, and the apparatus comprises a member facing the one of the cleaning units through the intermediate transfer body, the one of the cleaning units is applied to a voltage of the same polarity as the member facing the one of the cleaning units.

5. The apparatus according to claim 1, wherein:

one of the cleaning units is disposed on the most upstream in a moving direction of the intermediate transfer body among all the cleaning units, the one of the cleaning units is a brush-shaped cleaning unit, and a voltage of a negative polarity is applied to the one of the cleaning units.

6. The apparatus according to claim 1, wherein:

one of the cleaning units is disposed on the most upstream in a moving direction of the intermediate transfer body among all the cleaning units, and the one of the cleaning units is in contact with the intermediate transfer body.

7. The apparatus according to claim 1, wherein:

one of the cleaning units is disposed on the most upstream in a moving direction of the intermediate transfer body among all the cleaning units, and the one of the cleaning units is in non-contact with the intermediate transfer body.

8. The apparatus according to claim 1, wherein:

one of the cleaning units is disposed on the most upstream in a moving direction of the intermediate transfer body among all the cleaning units, and the one of the cleaning units has a less recovery rate of the residual toner from the intermediate transfer body than the others of the cleaning units disposed on a downstream of the one of the cleaning units in the moving direction of the intermediate transfer body.

9. The apparatus according to claim 1, wherein the plurality of cleaning units are disposed integrally.

10. The apparatus according to claim 1, further comprising:

an adjusting unit that adjusts an amount of the toner returned to the one of the developing units that supplies the black toner.

11. The apparatus according to claim 10, the adjusting unit adjusts the amount of the toner returned to the one of the developing units in accordance with at least one of:

image information, a toner density within the one of the developing units, and an environmental condition.

12. The apparatus according to claim 10, wherein:

one of the cleaning units is disposed on the most upstream in a moving direction of the intermediate transfer body among all the cleaning units, and the adjusting unit adjusts the amount of the toner returned to the one of the developing units by the one of the cleaning units.

13. The apparatus according to claim 10, wherein the adjusting unit adjusts a voltage applied to the second cleaning unit, to adjust the amount of the toner returned to the one of the developing units.

14. The apparatus according to claim 10, wherein the adjusting unit adjusts an amount of brush-belt interference by which the second cleaning unit bites into the intermediate transfer body, to adjust the amount of the toner returned to the one of the developing units.

15. The apparatus according to claim 10, wherein the adjusting unit adjusts a rotation speed of the second cleaning unit to adjust the amount of the toner returned to the one of the developing units.

16. The apparatus according to claim 10, wherein the second cleaning unit is a brush-shaped cleaning unit.

17. The apparatus according to claim 2, wherein the one of the cleaning unit disposed on the most upstream in a moving direction of the intermediate transfer body is the first cleaning unit.

* * * * *